US006632084B2

(12) United States Patent
Berenbrink

(10) Patent No.: US 6,632,084 B2
(45) Date of Patent: Oct. 14, 2003

(54) BURNER CONFIGURATION WITH PRIMARY AND SECONDARY PILOT BURNERS

(75) Inventor: Peter Berenbrink, Oberhausen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/794,662

(22) Filed: Feb. 27, 2001

(65) Prior Publication Data

US 2001/0024774 A1 Sep. 27, 2001

Related U.S. Application Data

(63) Continuation of application No. PCT/DE99/02520, filed on Aug. 12, 1999.

(30) Foreign Application Priority Data

Aug. 27, 1998 (DE) ..... 198 39 085

(51) Int. Cl.[7] ..... F23Q 3/00
(52) U.S. Cl. ..... 431/284; 431/285; 431/8
(58) Field of Search ..... 431/285, 8, 284, 431/183, 278, 279, 280, 281, 283, 9, 114

(56) References Cited

U.S. PATENT DOCUMENTS

| | | | | | |
|---|---|---|---|---|---|
| 2,591,458 | A | * | 4/1952 | McGuire | 431/285 |
| 2,619,159 | A | * | 11/1952 | Young | 431/283 |
| 2,636,554 | A | * | 4/1953 | Young | 431/187 |
| 2,918,966 | A | * | 12/1959 | Ferguson | 431/178 |
| 3,074,361 | A | * | 1/1963 | Etal | 110/104 R |
| 3,897,200 | A | * | 7/1975 | Childree | 431/166 |
| 4,347,052 | A | * | 8/1982 | Reed et al. | 431/188 |
| 4,572,084 | A | * | 2/1986 | Green et al. | 110/261 |
| 4,726,760 | A | * | 2/1988 | Skoog | 110/265 |
| 5,069,029 | A | * | 12/1991 | Kuroda et al. | 60/776 |
| 5,284,438 | A | * | 2/1994 | McGill et al. | 431/116 |
| 5,323,614 | A | * | 6/1994 | Tsukahara et al. | 60/737 |
| 5,385,467 | A | * | 1/1995 | Sebastiani et al. | 239/559 |
| 5,403,181 | A | * | 4/1995 | Tanaka et al. | 431/173 |
| 5,451,160 | A | * | 9/1995 | Becker | 431/183 |
| 5,511,970 | A | * | 4/1996 | Irwin et al. | 431/9 |
| 5,640,851 | A | * | 6/1997 | Toon et al. | 60/737 |
| 5,782,627 | A | | 7/1998 | Dobbeling et al. | |
| 5,846,067 | A | * | 12/1998 | Nishiyama et al. | 431/115 |
| 6,019,595 | A | * | 2/2000 | Wulfert et al. | 431/181 |
| 6,089,170 | A | * | 7/2000 | Conti et al. | 110/262 |
| 6,189,320 | B1 | * | 2/2001 | Poeschl et al. | 239/400 |
| 6,238,206 | B1 | * | 5/2001 | Cummings et al. | 431/10 |

FOREIGN PATENT DOCUMENTS

| | | |
|---|---|---|
| DE | 196 10 930 A1 | 9/1997 |
| EP | 0 108 361 B1 | 8/1985 |
| EP | 0 193 838 B1 | 5/1989 |
| EP | 0 747 636 A2 | 12/1996 |

* cited by examiner

*Primary Examiner*—Henry Bennett
*Assistant Examiner*—Kathryn Ferko
(74) *Attorney, Agent, or Firm*—Laurence A. Greenberg; Werner H. Stemer; Gregory L. Mayback

(57) ABSTRACT

A burner configuration with primary and secondary pilot burners is described. The burner configuration is used in a firing installation, in particular a gas turbine combustion chamber, and has a main burner and, disposed centrally within it, a primary pilot burner used for igniting and/or for stabilizing the combustion of the main burner. For additional stabilization, for reducing rumble noises in the firing installation and for avoiding the possible flashback of the flame in a partial region of the burner, which can then sometimes occur, a plurality of outlet openings, which together form a secondary pilot burner, are disposed in the outlet region of the main burner. The flames of the secondary pilot burner surround the main flame like a ring and additionally stabilize the operation under different load conditions.

10 Claims, 3 Drawing Sheets

BURNER CONFIGURATION WITH PRIMARY AND SECONDARY PILOT BURNERS

CROSS-REFERENCE TO RELATED APPLICATION

This application is a continuation of copending International Application No. PCT/DE99/02520, filed Aug. 12, 1999, which designated the United States.

BACKGROUND OF THE INVENTION

Field of the Invention

The present invention relates to a burner configuration for a firing installation, in particular a gas turbine combustion chamber, having a main burner and, disposed centrally within it, a primary pilot burner which is used for igniting and/or for stabilizing the combustion of the main burner. In addition, the present invention relates to a method of operating such a burner configuration.

Burner configurations of the generic type are often configured for different fuels and different modes of operation and, in view of the continually more strict regulations worldwide on the emission of pollutants, great efforts are being made to improve the configurations and modes of operation in such a way that the emission of pollutants is reduced.

Particularly environmentally friendly burners with a low emission of $NO_x$ are known from European Patent EP 0 108 361 B1 and European Patent EP 0 193 838 B1. Because the present invention deals precisely with a development of such burners, reference is made to the complete content of these two publications.

Published, Non-Prosecuted German Patent Application DE 196 10 930 A1 discloses a burner for a heat generator. In the burner, which consists essentially of a swirl generator for a combustion airflow and of a device for injecting a fuel into the combustion airflow, a mixing section is disposed downstream of the swirl generator mentioned. Within a first partial section, the mixing section has a number of transition ducts extending in the flow direction, which transition ducts ensure the continuous transfer of the flow formed in the swirl generator into a downstream mixing tube. The outlet plane of the mixing tube relative to the combustion chamber is configured with a final edge which serves to stabilize and increase a reverse-flow zone forming in the flow. A number of mixing elements, which serve to form a mixture of combustion air and a fuel, are provided concentrically with the mixing section. This mixture of the respective mixing elements then forms one pilot stage of the combustion chamber.

Although, in the known burner configurations, critical conditions of the burner can be substantially avoided by design measures and the mode of operation, there is nevertheless the possibility—particularly when the burner configuration is operated in premixed operation, i.e. when fuel and air are already intensively mixed with one another before the combustion zone—that the combustion in a firing installation exhibits fluctuations and sometimes becomes unstable, which can, for example be expressed by a firing installation rumble. The flame can then also, on occasion, flash back into a partial region of one of the burners, which is undesirable because of the increases in temperature of burner components caused by it and because of an increased emission of pollutants which then occurs.

SUMMARY OF THE INVENTION

It is accordingly an object of the invention to provide a burner configuration with primary and secondary pilot burners which overcomes the above-mentioned disadvantages of the prior art devices of this general type, which creates increased stabilization of the combustion and, helps avoid firing installation rumble due to unstable combustion and flashback of the flame into partial regions of the burner.

With the foregoing and other objects in view there is provided, in accordance with the invention, a burner configuration for a firing installation such as a gas turbine combustion chamber. The burner configuration contains a main burner having an outlet region and a primary pilot burner disposed centrally within the main burner. The primary pilot burner ignites and stabilizes a combustion of the main burner. A fuel supply line and a secondary pilot burner having a peripheral annular duct with a plurality of outlet openings formed therein and disposed in the outlet region of the main burner, are provided. The peripheral annular duct is connected to the fuel supply line and is in connection with the outlet openings, the outlet openings being directed in a direction towards a center of the outlet region.

Such a burner configuration for a firing installation, in particular a gas turbine combustion chamber, has the main burner and, disposed centrally within it, a primary pilot burner which is used for igniting and/or for stabilizing the combustion of the main burner. Details of such burners, which are also called hybrid burners because of the different possibilities with respect to mode of operation and fuel supply, are described, for example, in European Patent EP 0 108 361 B1 and European Patent EP 0 193 838 B1. In the invention of the instant application, such a burner configuration is now additionally equipped with a secondary pilot burner, the latter exhibiting a plurality of outlet openings in the outlet region of the main burner. Because fuel, or a mixture of air and fuel, emerges from these outlet openings, a ring of flame is formed which surrounds the flame emerging from the main burner approximately as an annulus and, by this, additionally stabilizes the flame. Whereas the primary pilot burner supports the combustion centrally, more or less from the inside out, the secondary pilot burner can contribute to the stabilization from the outside without negatively affecting the principle of combustion with recirculation, which is possessed by the burners of the prior art. The outer recirculation region, which is important for stable combustion in the burner flame, is in fact strengthened by the secondary pilot burner.

A particularly preferred configuration is for the secondary pilot burner to be formed by a peripheral annular duct in the outlet region of the main burner, which annular duct is connected to a fuel supply line and is in connection with the outlet openings. The peripheral annular duct surrounds the outlet region of the main burner more or less like a collar in which the outlet openings are disposed, preferably directed toward the inside in the direction of the center of the outlet region.

To avoid any limitation to the number or the cross-sectional area of the outlet openings, the peripheral annular duct is subdivided, in a particularly preferred embodiment example, into a lower annular duct and an upper annular duct, which are connected together by a throttle location, the upper annular duct being connected to the fuel supply line and the lower annular duct being in connection with the outlet openings. In this way, the fuel quantity for the secondary pilot burner is determined by the throttle location and not by the cross section of the outlet openings and their number. In this way, the lower annular duct acts as a resonance chamber so that the fuel quantity emerging at the outlet openings is influenced by the external pressure which, given appropriate design and dimensioning of this lower annular duct, acts in a strongly damping manner in the case of pressure vibrations, i.e. during burner configuration rumble for example.

According to the invention, the outlet openings can preferably be disposed in a ring, at approximately equal distances apart, in the outlet region of the main burner. This configuration is symmetrical to all sides and leads to uniform stabilization on all sides.

As an alternative, it is also possible to dispose the outlet openings in a ring, at different distances apart, in the outlet region of the main burner, this being useful, particularly in the case of combustion chamber configurations with a plurality of burners, in order to avoid accumulations of outlet openings in regions in which two burners come very close together. In addition, a non-uniform distribution of the outlet openings has a smaller tendency to vibration, and therefore to instabilities, than a uniform distribution because, in the case of pressure shocks, different pressure wave traverse times to or from the individual outlet nozzles occur due to different distances and this leads, at least partially, to mutual extinguishing of such pressure waves and therefore damps instabilities.

There is also a large degree of freedom with respect to the shape of the outlet openings. Particularly preferred, according to the invention, are round or oval outlet openings, which are particularly easy to manufacture.

Depending on the burner geometry, however, the outlet openings can have a polygonal edge, in particular in the form of a triangle with an apex pointing in the gas flow direction. The burner configuration with the secondary pilot burner is configured, according to the invention, in such a way that between 0 and 10% of the fuel quantity required at base load of the burner configuration can be supplied to the outlet openings, in particular in the form of fuel gas. Depending on the mode of operation of the burner configurations, it can be useful to appropriately throttle the fuel supply to the central primary pilot burner, which is now supported, according to the invention, by the secondary pilot burner, in order not to unduly increase the proportion of fuel which is supplied by the pilot burners overall.

In the burner configurations of the prior art, it is known art for the main burner and the primary pilot burner to be operated in premixed operation, in diffusion operation or in a mixed operation of both types of operation, it being also possible to configure the main burner and the primary pilot burner for optional operation with liquid and gaseous fuels. All these modes of operation are also possible in the case of a burner configuration according to the present invention. In addition, it is also possible to operate the secondary pilot burner as a premixing burner with a premixed mixture of fuel and air, which particularly contributes to reducing the generation of oxides of nitrogen.

The invention also relates to a method of operating the burner configuration, in particular to avoid instabilities in the combustion chamber, the associated rumble and the possible flashback of the flame in partial regions of the burner, the burner configuration having the main burner stabilized by the primary pilot burner and, according to the invention, the flame of the main burner being additionally stabilized by the secondary pilot burner, the secondary pilot burner having a plurality of outlet openings distributed around the outlet region of the main burner, which outlet openings are supplied separately, using open-chain control or closed-loop control, with fuel or fuel mixture. This method according to the invention provides a further parameter for the particularly reliable and environmentally friendly control of a burner configuration. The stabilization of the flame of the main burner by the outer secondary pilot burner inhibits unstable operating conditions such as rumble in the firing installation and, therefore, also inhibits flashback of the flame in partial regions of a burner.

Other features which are considered as characteristic for the invention are set forth in the appended claims.

Although the invention is illustrated and described herein as embodied in a burner configuration with primary and secondary pilot burners, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DESCRIPTION OF THE PREFERRED EMBODIMENTS

Figure 1:
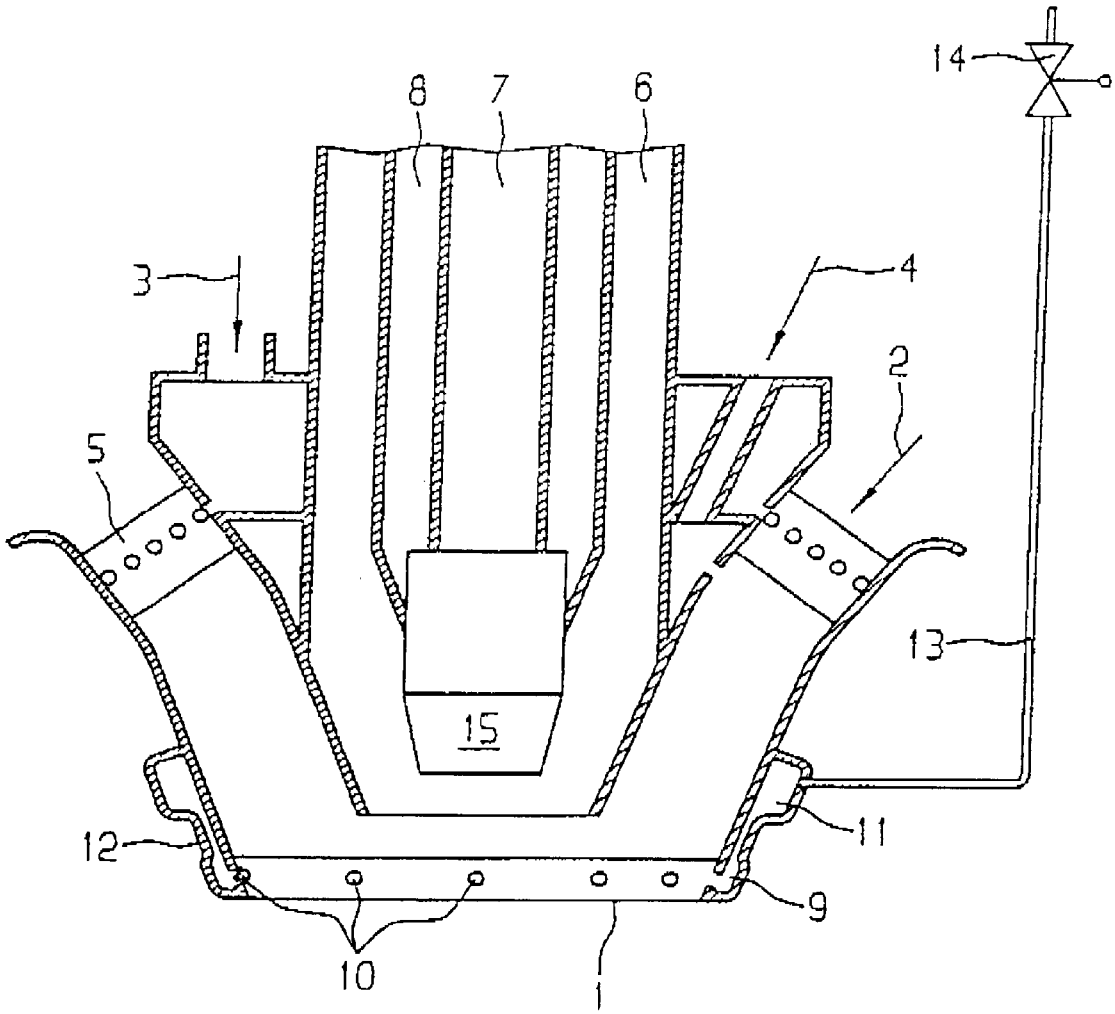
FIG. 1 is a diagrammatic, partial sectional view of a lower part of a burner configuration according to the invention, wherein the outlet openings of the secondary pilot burner have a round shape.

Referring now to the drawings, especially FIG. 1, in detail, there is shown a burner configuration. During an on-load operation of the burner configuration, a main burner 1 is supplied with main combustion air 2 into which fuel gas is injected, finely distributed in a main fuel gas injection system 3, and/or fuel oil is injected, in a main fuel oil injection system 4. This takes place in the region of a main swirl generator 5, in particular in the form of a diagonal cascade. In this way, the fuel is premixed with the main combustion air 60 that a low-pollutant Combustion can be achieved. A pilot burner 15 is located, in a manner known per se, in the center of the main burner 1 for igniting and/or for stabilizing the main flame, the combustion air for the pilot burner is being supplied by an air duct 6. There is a central fuel duct 7 for the operation of the pilot burner 15 as a diffusion burner. In order also to permit operation of the pilot burner 15 as a premixing burner, there is also an outer fuel duct 8. This known burner configuration can, fundamentally, be operated in very varied modes of operation using different fuels, for which reason such burners are also known as hybrid burners.

According to the invention, a secondary pilot burner having an annular duct 9 is located at a lower outer edge of the main burner 1, the annular duct 9 is in connection with outlet openings 10 of the secondary pilot burner. The outlet openings 10 are disposed in a ring in an outlet region 20 of the main burner 1.

Depending on requirements, a distance between the outlet openings 10 can be uniform or non-uniform. Depending on the requirement, the shapes and cross-sectional areas of the outlet openings 10 can also be varied within wide limits although uniformly distributed, round outlet openings 10 are preferred. In the present embodiment example, a fuel supply system for the outlet openings 10 has the lower annular duct 9, which is in connection with an upper annular duct 11 through a throttle location 12. The upper annular duct 11 is in turn supplied with fuel, preferably fuel gas, by a fuel supply line 13 and a valve 14. In this embodiment, the pressure in the upper annular duct 11 is approximately constant because main pressure loss occurs at the throttle location 12. The lower annular duct 9 can partially compensate for external pressure vibrations in the flame of the main burner 1 and thus acts as a type of resonance chamber. If the pressure in the flame is high, only a small amount of fuel flows briefly through the outlet openings 10 of the secondary pilot burner; when the external pressure is again falling, more fuel gas flows subsequently. This behavior damps external vibrations and therefore reduces the rumble, which can occur in the case of instabilities of the flames in a firing installation.

Figure 2:
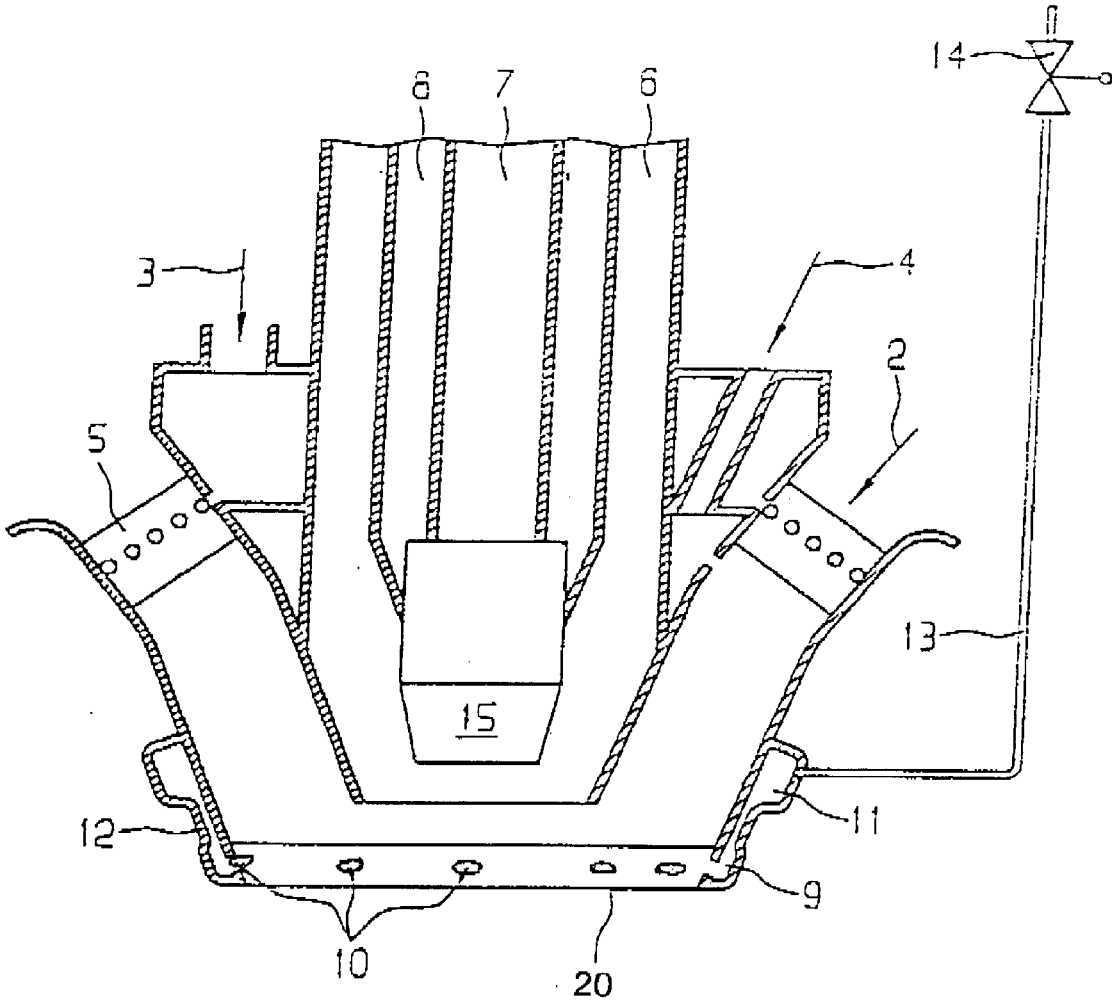
FIG. 2 is a diagrammatic, partial sectional view of a lower part of a burner configuration according to the invention, wherein the outlet openings of the secondary pilot burner have an oval shape.
Figure 3:
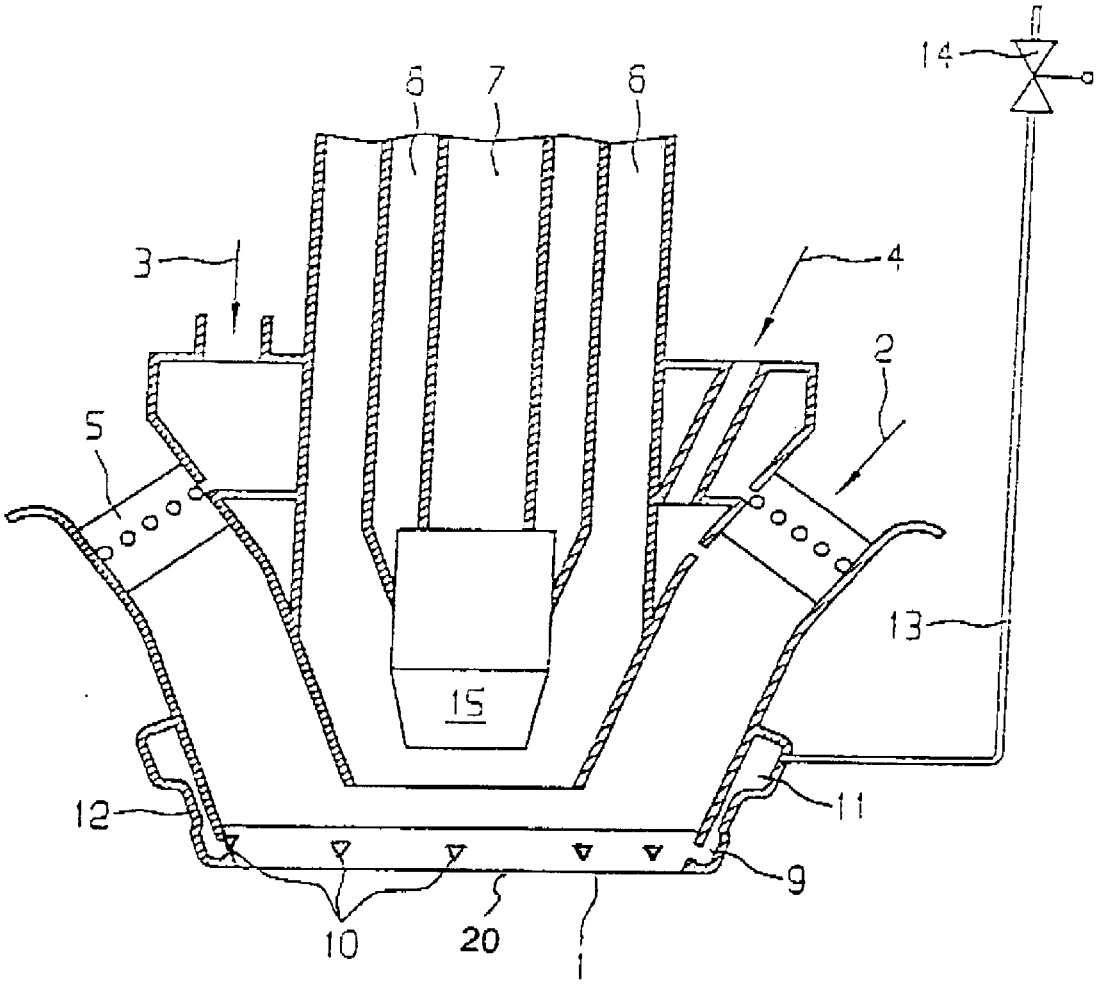
FIG. 3 is a diagrammatic, partial sectional view of a lower part of a burner configuration according to the invention, wherein the outlet openings of the secondary pilot burner have a triangle shape.

FIG. 2 and FIG. 3 show respectively the outlet openings 10 in an oval shape and a triangular shape.

The present invention is particularly suitable for the additional stabilization of burner configurations in gas turbine chambers and avoids the flashback of the flame in a burner configuration or at least reduces the rumble caused by it.

I claim:

1. A burner configuration for a firing installation, comprising:

a main burner having an outlet region and a main burner fuel supply line;

a primary pilot burner disposed centrally within said main burner, said primary pilot burner used for igniting and stabilizing a combustion of said main burner, said primary pilot burner having a primary pilot burner fuel supply line; and a secondary pilot burner having a peripheral annular duct with a plurality of outlet openings formed therein and disposed in said outlet region of said main burner, said secondary pilot burner having a secondary pilot burner fuel supply line, said peripheral annular duct fluidically connected to said secondary pilot burner fuel supply line and fluidically connected to said outlet openings, said outlet openings being directed in a direction towards a center of said outlet region;

said peripheral annular duct having a lower annular duct, an upper annular duct, and a throttle location connecting said lower annular duct to said upper annular duct, said upper annular duct being connected to said secondary pilot burner fuel supply line and said lower annular duct being in connection with said outlet openings.

2. The burner configuration according to claim 1, wherein said outlet openings are disposed in a ring, at approximately equal distances apart, in said outlet region of said main burner.

3. The burner configuration according to claim 1, wherein said outlet openings are disposed in a ring, at different distances apart, in said outlet region of said main burner.

4. The burner configuration according to claim 1, wherein said outlet openings have a shape selected from the group consisting of round shapes and oval shapes.

5. The burner configuration according to claim 1, wherein said outlet openings have a polygonal edge, in a form of a triangle with an apex pointing in a gas flow direction.

6. The burner configuration according to claim 1, wherein said main burner fuel supply line, said primary pilot burner fuel supply line, said secondary pilot burner fuel supply line, said peripheral annular duct, and said outlet openings are adapted to supply between approximately 0 and approximately 10% of a fuel quantity required at a base load of the burner configuration to said outlet openings.

7. The burner configuration according to claim 1, wherein said main burner and said primary pilot burner can be operated in a premixed operation, in a diffusion operation and in a mixed operation of both types of operation, and said main burner and said primary pilot burner operating with a fuel selected from the group consisting of liquid fuels and gaseous fuels.

8. The burner configuration according to claim 1, wherein said secondary pilot burner operates as a premixing burner with a premixed mixture of fuel and air.

9. The burner configuration according to claim 1, wherein said main burner fuel supply line, said primary pilot burner fuel supply line, and said secondary pilot burner fuel supply line are adapted to transport a fuel gas.

10. The burner configuration according to claim 1, wherein the burner configuration is used in a gas turbine combustion chamber.

* * * * *